US005212038A

United States Patent [19]

Watanabe et al.

[11] Patent Number: 5,212,038

[45] Date of Patent: May 18, 1993

[54] DEVELOPER AND PROCESS FOR PREPARATION THEREOF

[75] Inventors: Akihiro Watanabe; Katsumi Oyama, both of Neyagawa; Yoshihisa Kuramae, Hirakata; Mitsushi Kuroki, Kumamoto; Noriaki Tsubota, Himeji, all of Japan

[73] Assignee: Mita Industrial Co., Ltd., Osaka, Japan

[21] Appl. No.: 565,142

[22] Filed: Aug. 10, 1990

[30] Foreign Application Priority Data

Aug. 21, 1989 [JP] Japan ..... 1-212927
Jan. 31, 1990 [JP] Japan ..... 2-23036

[51] Int. Cl.[5] ..... G03G 9/08; G03G 9/00
[52] U.S. Cl. ..... 430/122; 430/108; 430/110; 430/137
[58] Field of Search ..... 430/106.6, 122

[56] References Cited

U.S. PATENT DOCUMENTS

| | | | |
|---|---|---|---|
| 4,254,203 | 3/1981 | Oka et al. | 430/120 |
| 4,284,702 | 8/1981 | Tabuchi et al. | 430/122 |
| 4,345,015 | 8/1982 | Hendriksma et al. | 430/137 |
| 4,526,851 | 7/1985 | Boughton et al. | 430/107 |
| 5,032,482 | 7/1991 | Kinoshita et al. | 430/102 |

*Primary Examiner*—Marion E. McCamish
*Assistant Examiner*—Stephen C. Crossan
*Attorney, Agent, or Firm*—Sherman and Shalloway

[57] ABSTRACT

Disclosed are a two-component type developer for use in the electrophotography or electrostatic printing, which comprises a magnetic carrier and a toner, and a process for the preparation thereof. This developer has a dynamic resistivity (Rd) lower than the dynamic resistivity (Rc) of the magnetic carrier. This developer is prepared by mixing a toner with a magnetic carrier so that the dynamic resistivity (Rd) of the formed developer is lower than the dynamic resistivity (Rc) of the magnetic carrier. This developer is capable of realizing an excellent reproducibility of a fine line image and a high density of a solid image area simultaneously.

10 Claims, 2 Drawing Sheets

DEVELOPER AND PROCESS FOR PREPARATION THEREOF

BACKGROUND OF THE INVENTION (1) Field of the Invention

The present invention relates to a two-component type developer for use in the electrophotography and electrostatic printing, and a process for the preparation thereof. More particularly, the present invention relates to a two-component type developer capable of realizing an excellent reproducibility of a fine image and a high density of a solid image area simultaneously, and also to a process for the preparation thereof.

(2) Description of the Related Art

A two-component type developer comprising a magnetic carrier and a toner is widely used for commercial electrophotographic copying machines, and in developing a charged image, a magnetic brush of this developer is formed on a developing sleeve having magnetic poles arranged in the interior thereof, and this magnetic brush is brought into sliding contact with a photosensitive material having the charged image to form a toner image.

Recently, a carrier composed of spherical ferrite sintered particles or a carrier composed of such sintered particles coated with a resin is widely used, and the resistivity of the magnetic carrier is generally increased for improving the quality of a copied image. If the resistivity of the carrier is increased, the reproducibility of line images is improved, but the density of a solid image area is often reduced because the edge effect.

Changes of electric characteristics by increase of the resistivity of a carrier in the above-mentioned two-component type developer have not been sufficiently elucidated, and it is still difficult to obtain an image which is satisfactory in both of the high density of a solid image and the reduced deviation in a line image area.

SUMMARY OF THE INVENTION

The present invention has been completed under this background. It is therefore a primary object of the present invention to provide a dry two-component type developer for the electrophotography, which is capable of realizing an excellent reproducibity of line images and a high density of a solid image simultaneously.

Another object of the present invention is to provide a dry two-component type developer which can be widely applied to the electrophotographical reproduction utilizing the magnetic brush development technique and is characterized by a large quantity, a reduced scattering of a toner and an charge quantity, a reduced scattering of a toner and an excellent durability.

Still another object of the preparation of a two-component type developer in which an edge effect is exerted in the reproduction of fine line images and the amount of a toner adhering to a latent image is increased in the development of a solid image.

In accordance with the present invention, there is provided a two-component type developer, which comprises a magnetic carrier and an electroscopic toner, wherein the dynamic resistivity (Rd) of the developer is lower than the dynamic resistivity (Rc) of the magnetic carrier.

In the developer of the present invention, it is preferred that the magnetic carrier be a carrier having a dynamic resistivity of $5\times10^{9}$ to $5\times10^{11}$ Ω-cm and the toner be a toner having a static electroconductivity of $6\times10^{-10}$ to $4\times10^{-9}$ s/cm and a dielectric constant (ε) of 2.7 to 3.9.

In the developer of the present invention, it is preferred that the ratio (Rd/Rc) of the dynamic resistivity (Rd) of the developer to the dynamic resistivity (Rc) of the magnetic carrier be in the range of from 0.20 to 0.99.

Furthermore, in the developer of the present invention, it is preferred that the electroconductivity of a binder resin constituting the toner be $1\times10^{-10}$ to $1\times10^{-8}$ s/cm.

Moreover, according to the present invention, there is provided a process for the preparation of a two-component type developer comprising a magnetic carrier and a toner, said process comprising mixing the toner with the magnetic carrier so that the dynamic resistivity (Rd) of the developer is lower than the dynamic resistivity (Rc) of the magnetic carrier.

In the process for preparing a developer according to the present invention, it is preferred that the static electroconductivity of the toner be $6\times10^{-10}$ to $4\times10^{-9}$ s/cm.

Furthermore, in the process for preparing a developer according to the present invention, it is preferred that the electroconductivity of a binder resin constituting the toner be $1\times10^{-10}$ to $1\times10^{-8}$ s/cm.

DETAILED DESCRIPTION OF THE PREFERRED EMBODIMENTS

The present invention is based on the surprising finding that if a two-component type developer comprising a magnetic carrier and a toner, which has a dynamic resistivity (Rd) lower than the dynamic resistivity (Rc) of the carrier, is used, an excellent reproducibility of line images and an enhanced density of a solid image can be simultaneously attained.

In the instant specification and appended claims, by the dynamic resistivity is meant the resistivity of the carrier or developer in the state where a magnetic brush is formed on the developing sleeve and is moving thereon, and this dynamic resistivity is quite different from the resistivity heretofore measured in the static state in not only the measuring means but also the significance. This dynamic resistivity is measured by using the measurement apparatus shown in FIG. 1 in the following manner.

Figure 1:
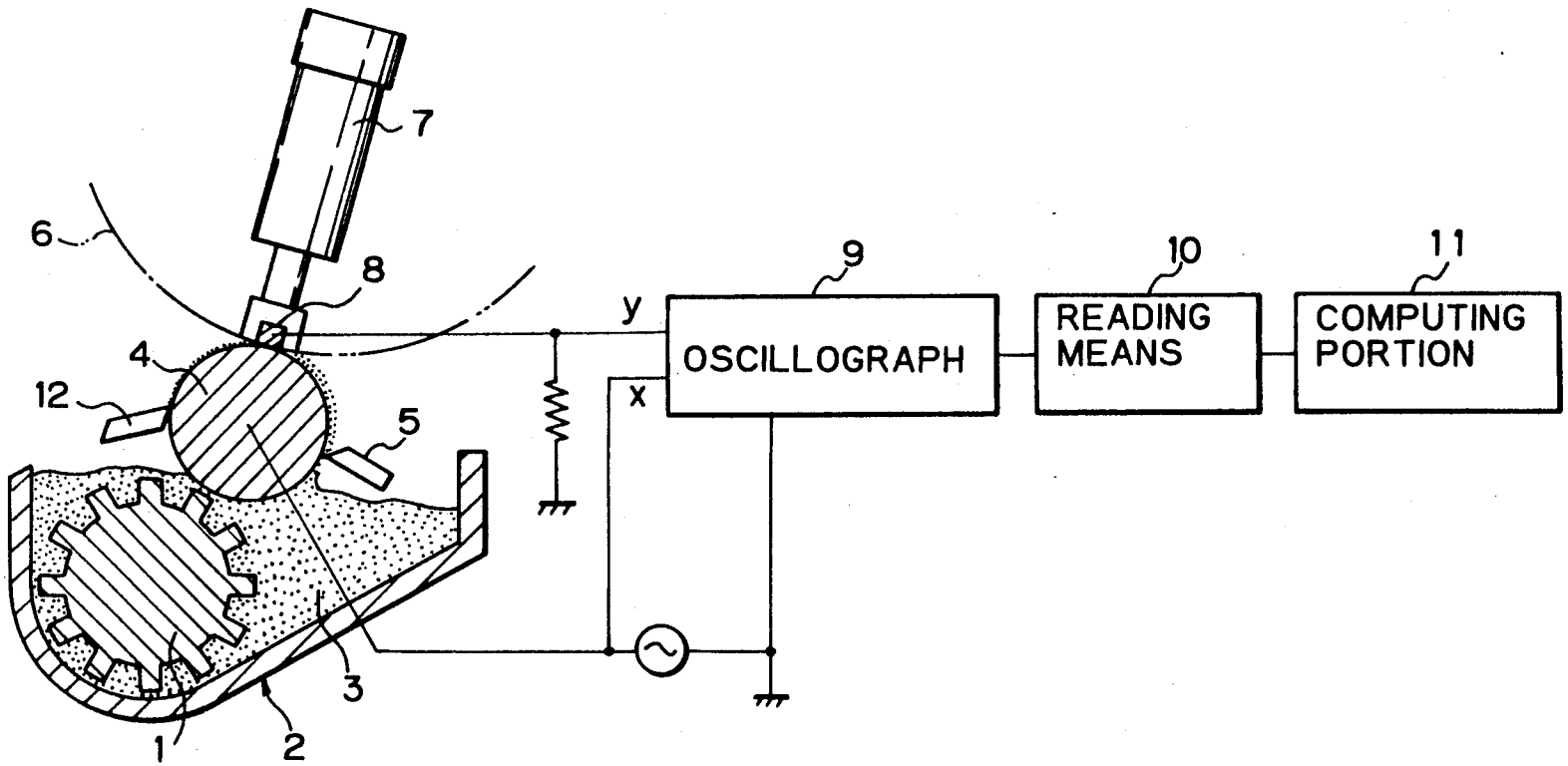
FIG. 1 is a diagram illustrating the apparatus for measuring the dynamic resistivity of a developer or a magnetic carrier.

Referring to FIG. 1, a carrier (or developer) 3 is introduced into a developing device 2 provided with a stirring roller 1 to support the carrier 3 on a sleeve 4. The layer of the carrier 3 is adjusted to a predetermined thickness by a brush height-regulating member 3 and the carrier 3 is delivered in this state. A detecting portion 8 having a predetermined area is arranged along an imaginary line 6 on the surface of a photosensitive material confronting the sleeve 4 with a certain spacing by a using a micrometer 7 as the electrode spacing-adjusting means. While the carrier 3 is delivered together with the sleeve 4, an alternating current voltage of a predetermined frequency is applied to the sleeve 4, and a detection signal y from the detecting portion 8 is supplied to a parallel circuit comprising a dummy and an oscillograph 9. A waveform data on the oscillograph 9 is read by reading means 10 and the electric resistivity is calculated at a computing portion 11.

Incidentally, in the drawings, reference numeral 12 represents a cleaning blade as the cleaning means for removing the carrier 3 left on the sleeve 4.

As regards specific measurement conditions, the distance between the sleeve 4 and detecting portion 8, that is, the electrode spacing d, is adjusted to 1.2 mm, and the surface area of the detecting portion 8, that is, the electrode area a, is adjusted to 0.785 $cm^2$. An alternating current having a frequency of 50 Hz is used. By using the carrier as the magnetic brush, the dynamic resistivity Rc of the carrier is determined, and if the two-component developer is used as the magnetic brush, the dynamic resistivity Rd of the developer is determined.

The fact that in the developer of the present invention, the dynamic resistivity Rd of the developer is lower than the dynamic resistivity Rc of the carrier indicates the surprising fact in the state where an electroscopic toner is incorporated into a carrier, the electric resistivity is lower than in the state where the carrier alone is present, and the developing current flows more easily. According to the present invention, if the following requirement:

$$Rd < Rc \quad (1)$$

is satisfied, in the reproduction of congregated fine lines, an excellent reproducibility is attained without front end lacking or rear end lacking or deviation of fine lines, and the density of a solid image is prominently improved. This unexpected effect has been found as the result of many experiments conducted by us, and the theoretical ground has not been sufficiently elucidated. However, the following reasons can be considered. Namely; in the developer of the present invention, since the carrier has a high resistivity and the resistivity of the developer is lower than that of the carrier, the edge effect of an electrostatic latent image is high but it is considered that the development is advanced under a condition where the charge moderation time is relatively short. In order words, it is considered that fine lines are faithfully reproduced by the edge effect, while in the development of a solid image, the moderation of charges is conducted at a relatively high speed to increase the amount of the adhering toner, resulting in increase of the density of the solid image.

From the viewpoint of the reproducibility of fine lines, it is generally preferred that the dynamic resistivity (Rc) of the magnetic carrier be $5\times10^9$ to $5\times10^{11}$ Ω-cm, and in view of the improvement of the image density of a solid image portion and the maintenance of a good balance between the reproducibility of fine lines and the density of a solid image portion, it is preferred that the ratio Rd/Rc be in the range of from 0.20 to 0.99, especially from 0.3 to 0.7.

Figure 2:
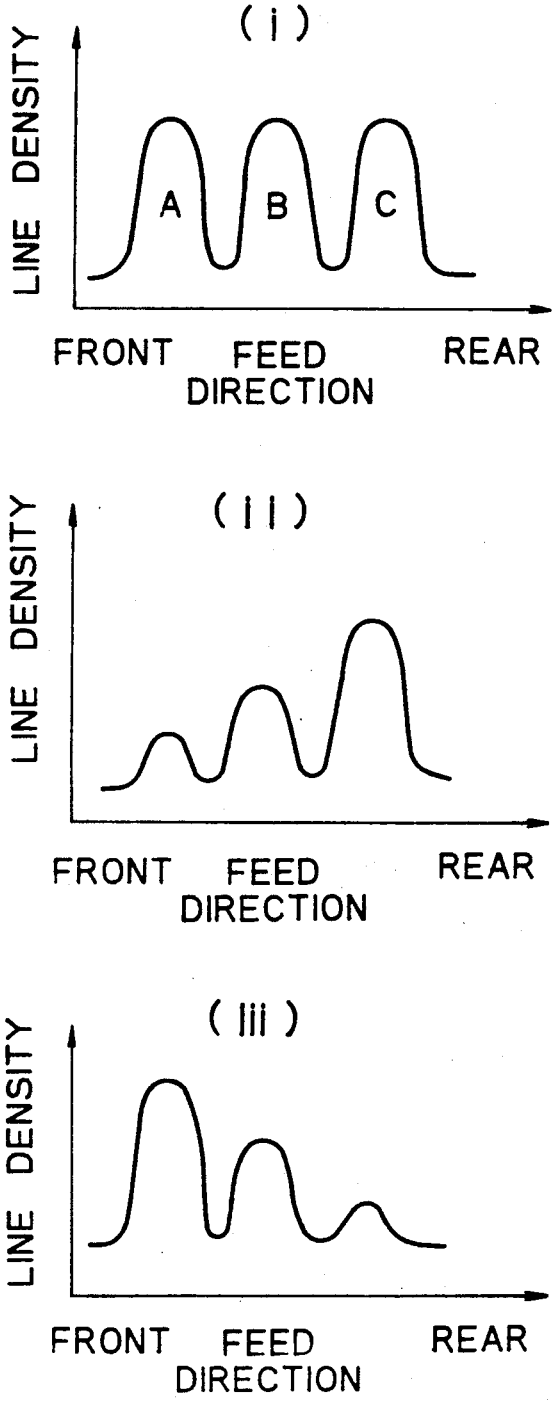
FIG. 2 is a diagram illustrating front end lacking or rear end lacking caused in the development of congregated fine lines.

Referring to FIG. 2, illustrating front end lacking or rear end lacking caused in the development of fine lines, the distance in the feed direction is plotted on the abscissa and the reflection density of a copied image of congregated fine lines determined by a microdensitometer is plotted on the ordinate, and the relation between these two factors is shown in the graph of FIG. 2. In FIG. 2, curve (i) shows the state where the line width is constant among the respective lines and front end lacking or rear end lacking is not caused, curve (ii) shows the state where front end lacking is conspicuous, and curve (iii) shows the state where rear end lacking is conspicuous. The deviation (δ) of the width in reproduced lines in the feed direction is given by the following formula:

$$\delta = \frac{B+C}{A+B} \times 100 \quad (2)$$

wherein A, B and C represent image densities of peaks in order in the feed direction.

It is seen that if the value δ is 100 or close thereto, the width is constant among respective lines and there is not deviation of the line width. It also is seen that if the value δ is considerably larger than 100, front end lacking is caused and if the value δ is considerably smaller than 100, rear end lacking is caused.

If the dynamic resistivity of the magnetic carrier used is lower than $5\times10^9$Ω-cm, the value δ is generally smaller than 80 and rear end lacking is caused. If the dynamic resistivity of the magnetic carrier used is higher than $5\times10^{11}$Ω-cm, the value is generally larger than 120 and front end lacking tends to occur, and the optical density of a solid image portion becomes lower than 1.2 and reduction of the image density becomes conspicuous. In accordance with one preferred embodiment of the present invention, by using a magnetic carrier having a dynamic resistivity within the above-mentioned range, the value δ can be adjusted to 80 to 120, especially 90 to 110, and the reproducibility of a line image can be prominently improved.

Respective conditions will now be described in detail.

Magnetic Carrier

Any of magnetic carriers can be optionally used as the magnetic carrier, so far as the dynamic resistivity (Rc) is within the above-mentioned range. In general, a magnetic carrier formed by coating the surfaces of ferrite particles with a high-resistivity resin so that the dynamic resistivity is adjusted within the abovementioned range is used.

Spherical particles are preferably used as the ferrite particles, and it is preferred that the particle size of the ferrite particles be 20 to 140 μm, especially 50 to 100 μm.

Sintered ferrite particles composed of at least one member selected from the group consisting of zinc iron oxide ($ZnFe_2O_4$), yttriium iron oxide ($Y_3Fe_5O_{12}$), cadmium iron oxide ($CdFe_2O_4$), gadolinium iron oxide ($GdFe_5O_{12}$), lead iron oxide ($PbFe_{12}O_{19}$), nickel iron oxide ($NiFe_2O_4$), neodium iron oxide ($NdFeO_3$), barium iron oxide ($BaFe_{12}O_{19}$), magnesium iron oxide ($MgFe_2O_4$), manganese iron oxide ($MnFe_2O_4$) and lanthanum iron oxide ($LaFeO_3$) can be used. Preferably, soft ferrites comprising at least one metal component, especially at least two metal components, selected from the group consisting of Cu, Zn, Mg, Mn and Ni, for example, copper/zinc/magnesium ferrite, can be used.

The dynamic resistivity of the ferrite particles depends on the kind and amount of the resin coated on the surfaces. As the coating resin to be coated on the surfaces of the ferrite particles, there can be used at least one member selected from the group consisting of a silicone resin, a fluorine resin, an acrylic resin, a styrene resin, a styrene/acrylic resin, an olefin resin, a ketone resin, a phenolic resin, a xylene resin, a diallyl phthalate resin and a polyester resin. Among these resins, a straight silicone resin, that is, a solicone resin composed of a polyorganosiloxane such as dimethylpolysiloxane, diphenylsoloxane or methylphenylpolysiloxane and having a crosslinked network structure, is most preferably used. Formation of the network structure (crosslinking) can be accomplished by making a hydrolyzable functional group such a trimethoxy group or other functional group such as a silanol group present in organopolysiloxane units, and after the hydrolysis conducted according to need, reacting the resin with a silanol condensing catalyst. The amount coated of the resin is selected within the range of 0.5 to 3 parts by weight, especially 0.8 to 1.5 parts by weight, per 100 parts by weight of the ferrite so that the value of Rc falls within the above-mentioned range.

Electroscopic Toner

A toner having a relatively high electroconductivity is preferably used as the toner to be mixed with the magnetic carrier particles for adjusting the dynamic resistivity within the abovementioned range in the present invention.

The electroconductivity of the toner can be increased by adopting at least one means selected from use of a colorant having an excellent electroconductivity, increase of the amount incorporated of an electroconductive colorant, use of a resin having a high electroconductivity, incorporation of an electroconductivity-imparting agent separately from a colorant, use of a toner surface-treating agent having a high electroconductivity.

A resin having a polar group is preferably used as the resin having a relatively high electroconductivity. For example, there can be mentioned an acrylic resin, a styrene/acrylic copolymer resin, a polyester resin and an epoxy resin. in the present invention, it is preferred that the electroconductivity of the resin be generally $1\times10^{-10}$ to $1\times10^{-8}$ s/cm, especially $6\times10^{-10}$ to $4\times10^{-9}$ s/cm.

Carbon black is generally used as the black colorant. Carbon black easily forming a chain structure and having a fine particles size, a large oil absorption and a large BET specific surface area is preferably used. In general, it is preferred that carbon black having a specific surface area of at least 50 $m^2/g$ be used. The amount incorporated of carbon black is preferably 2 to 20 parts by weight, especially preferably 5 to 10 parts by weight, per 100 parts by weight of the resin. Among known chromatic colorants those having a relatively high electroconductivity are selected and used. However, chromatic colorants generally have a low electroconductivity, and therefore, as electroconductivity-imparting agent is preferably used separately from the colorant.

In order to prevent degradation of the color of the toner, an electrodonductivity-imparting agent having a white color is preferably used. For example, there can be mentioned zinc oxide, tin oxide, titanium oxide and barium oxide. The resistivity of the electroconductivity-imparting agent is generally lower than 100 Ω-cm.

As the surface-treating agent having an electroconductivity, fine particles of silicon carbide, zinc oxide, tin oxide, magnetite, ferrite and carbon black having a high electroconductivity can be used.

Known toner additives, for example, charge-controlling agents such as Nigrosine Base, 1:1 and 2:1 metal complex salt dyes and metal compounds of salicylic acid and alkyl salicylates, and offset-preventing agents such as a silicone oil and a low-molecular-weight olefin polymer can be incorporated into the toner.

It is preferred that the toner particles should have such a particle size that the median diameter based on the volume, measured by a Coulter Counter, is 7 to 14 μm, especially 9 to 12 μm. The particle shape may be an inderminate shape obtained through melt kneading, pulverization and classification or a spherical shape obtained by the suspension polymerization or the dispersion polymerization.

The toner can be surface-treated with a known surface-treating agent such as fine resin particles of an acrylic polymer, a silicone resin or a fluorine resin or inorganic fine particles of silica, alumina, titanium oxide or tin oxide.

In the present invention, the static electroconductivity of the toner is preferably $6\times10^{-10}$ to $4\times10^{-9}$ s/cm, especially $9\times10^{-10}$ to $4\times10^{-9}$ s/cm. If the electroconductivity of the toner is too low and below the above-mentioned range, it is difficult to reduce the electroconductivity of the developer. If the electroconductivity of the toner is too high and exceeds the above-mentioned range, the frictional chargeability with the carrier is reduced and insufficient charging of the toner is readily caused. It is preferred that the dielectric constant ($\epsilon$) of the toner be in the range of from 2.7 to 3.9. If the dielectric constant is large, the field intensity is emphasized at the development and the development-stopping potential is reduced, and the amount of the toner used for the development becomes large. However, if the dielectric constant is too large, the edge effect is emphasized and fogging is readily caused by induction polarization.

Preparation of Developer

In the present invention, it is sufficient in the final developer if the dynamic resistivity of the developer comprising the magnetic carrier and the toner is lower than the dynamic resistivity of the magnetic toner. Namely, the above-mentioned magnetic carrier is mixed with the above-mentioned electroscopic toner by using a known mixing apparatus such as a Henschel mixer or a V-type mixer, and the resistivities of the carrier and developer in the dynamic state are measured by the measuring apparatus described hereinafter with reference to FIG. 1, and a preferred mixing ratio is determined based on the results of the measurement of the resistivities.

According to the present invention, the mixing ratio between the magnetic carrier and the electroscopic toner can be determined based on the relation between the dynamic resistivity of the magnetic carrier and the dynamic resistivity of the developer. Namely, by using a developer having a dynamic resistivity (Rd) lower than the dynamic resistivity (Rc) of the magnetic carrier, the reproducibility line images can be highly improved and furthermore, the density of solid images can be prominently increased.

The present invention will now be described in detail with reference to the following experiments.

Experiment A

Various developers shown in Table 1 were prepared by using various carriers and various toners while measuring the dynamic resistivityes (Rd) of the developers by using the apparatus shown in FIG. 1. In Table 1, runs 1 through 8 are runs according to the present invention, and runs 9 through 13 are comparative runs. Each of the obtained developers was subjected to an image-forming test by using a commercial electrophotographic copying machine (Model DC-2585 supplied by Mita Industrial Co., Ltd.) under conditions of a drum/sleeve distance of 1.2 mm, a photosensitive surface potential of 800 V, a brush cut length of 1.0 mm and a sleeve/drum peripheral speed ratio of 2.75. With respect to each of the obtained images, the image density of the solid image area, the deviation of fine lines, the image fogging density and the toner scattering were evaluated. The obtained results are shown in Table 1. Incidentally, the image density and image fogging density were measured by a reflection densitometer and the degree of the toner scattering was judged by the visual inspection of the interior of the copying machine after the copying operation. The properties of the toners used are shown in Table 2.

Experiment B

In runs 11 and 13 of Experiment A, the obtained images were insufficient. In run 13, the toner concentration was increased to 4.0% and the dynamic resistivity was changed to 0.97. By using this toner, the copy-forming operation was carried out. A good image having an image density of 1.401, an image fogging density of 0.003 and a line image deviation of 83% was obtained without substantial scattering of the toner. In run 11, toner 2 used was changed to toner 6 having a higher electroconductivity, and the toner concentration was changed to 3.5%. A good image having an image density of 1.31 and a line image deviation of 115% was obtained by this modification.

From the results obtained in Experiments A and B, it is seen that a developer having a dynamic resistivity

TABLE 1

| Run No. | Physical Properties of Carrier: dynamic resistivity (Rc) (· cm) | particle size (m) | saturation magnetization (emu/g) | coating resin | coated amount (parts by weight per 100 parts by weight of ferrite) | Physical Properties of Toner: electroconductivity (s/cm) | dielectric constant |
|---|---|---|---|---|---|---|---|
| present invention | | | | | | | |
| 1 | $8.7 \times 10^{10}$ | 100 | 52 | acrylic | 0.8 | $2.0 \times 10^{-9}$ | 3.25 |
| 2 | $4.5 \times 10^{10}$ | 95 | 52 | styrene-acrylic | 1.2 | $2.2 \times 10^{-9}$ | 3.20 |
| 3 | $4.0 \times 10^{11}$ | 75 | 45 | silicone | 1.3 | $3.8 \times 10^{-9}$ | 3.55 |
| 4 | $8.1 \times 10^{10}$ | 95 | 52 | silicone | 1.1 | $2.0 \times 10^{-9}$ | 3.24 |
| 5 | $7.7 \times 10^{10}$ | 95 | 52 | acrylic | 1.4 | $2.0 \times 10^{-9}$ | 3.24 |
| 6 | $7.7 \times 10^{10}$ | 95 | 52 | acrylic | 1.4 | $2.0 \times 10^{-9}$ | 3.24 |
| 7 | $2.1 \times 10^{11}$ | 70 | 48 | silicone | 1.0 | $1.5 \times 10^{-9}$ | 3.10 |
| 8 | $3.5 \times 10^{11}$ | 65 | 46 | silicone | 0.9 | $5.2 \times 10^{-10}$ | 3.03 |
| comparison | | | | | | | |
| 9 | $5.9 \times 10^{9}$ | 100 | 40 | silicone | 1.3 | $2.2 \times 10^{-9}$ | 3.20 |
| 10 | $2.5 \times 10^{10}$ | 135 | 55 | styrene-acrylic | 0.6 | $2.2 \times 10^{-9}$ | 3.20 |
| 11 | $5.2 \times 10^{11}$ | 100 | 55 | acrylic | 2.2 | $2.2 \times 10^{-9}$ | 3.20 |
| 12 | $8.5 \times 10^{9}$ | 135 | 55 | fluorine | 2.5 | $2.2 \times 10^{-9}$ | 3.20 |
| 13 | $2.4 \times 10^{10}$ | 115 | 55 | styrene | 0.5 | $4.3 \times 10^{-9}$ | 3.64 |

| Run No. | Dynamic Resistivity (Rd) (· cm) of Developer | Rd/Rc | Weight Ratio (%) of Toner in Developer | Image Characteristic: image density of solid image area | deviation (%) of line images | image fogging density | scattering of toner |
|---|---|---|---|---|---|---|---|
| present invention | | | | | | | |
| 1 | $3.1 \times 10^{10}$ | 0.36 | 4.0 | 1.365 | 86 | 0.001 | not observed |
| 2 | $3.0 \times 10^{10}$ | 0.67 | 3.0 | 1.376 | 88 | 0.001 | not observed |
| 3 | $3.0 \times 10^{10}$ | 0.52 | 3.0 | 1.324 | 108 | 0.001 | not observed |
| 4 | $3.6 \times 10^{10}$ | 0.44 | 2.0 | 1.354 | 92 | 0.001 | not observed |
| 5 | $3.3 \times 10^{10}$ | 0.43 | 3.3 | 1.380 | 85 | 0.001 | not observed |
| 6 | $3.1 \times 10^{10}$ | 0.40 | 3.5 | 1.402 | 84 | 0.002 | not observed |
| 7 | $1.4 \times 10^{11}$ | 0.69 | 5.5 | 1.376 | 90 | 0.001 | not observed |
| 8 | $2.5 \times 10^{11}$ | 0.71 | 5.5 | 1.369 | 87 | 0.002 | not observed |
| comparison | | | | | | | |
| 9 | $3.2 \times 10^{11}$ | 5.42 | 3.2 | 1.033 | 81 | 0.001 | slight |
| 10 | $2.9 \times 10^{11}$ | 1.16 | 2.1 | 1.383 | 74 | 0.007 | slight |
| 11 | $5.3 \times 10^{11}$ | 1.02 | 3.0 | 1.021 | 122 | 0.002 | not observed |
| 12 | $2.9 \times 10^{10}$ | 3.41 | 2.2 | 1.001 | 88 | 0.001 | slight |
| 13 | $3.2 \times 10^{10}$ | 1.33 | 2.4 | 1.393 | 73 | 0.011 | considerable |

TABLE 2

| Toner No. | Toner Electro-conductivity (s/cm) | Dielectric Constant of Toner | Resin Electro-conductivity (s/cm) | Kind of Resin | Carbon Black BET Specific Surface Area ($m^2/g$) | Amount of Carbon Black (parts by weight per 100 parts by weight of resin) |
|---|---|---|---|---|---|---|
| 1 | $2.0 \times 10^{-9}$ | 3.25 | $1.8 \times 10^{-9}$ | acrylic | 200 | 8.5 |
| 2 | $2.2 \times 10^{-9}$ | 3.20 | $1.7 \times 10^{-9}$ | styrene-acrylic | 300 | 8.5 |
| 3 | $3.8 \times 10^{-9}$ | 3.55 | $1.9 \times 10^{-9}$ | styrene-acrylic | 300 | 8.5 |
| 4 | $1.5 \times 10^{-9}$ | 3.10 | $1.6 \times 10^{-9}$ | styrene-acrylic | 330 | 5.0 |
| 5 | $5.2 \times 10^{-10}$ | 3.03 | $1.3 \times 10^{-9}$ | polyester | 250 | 5.0 |
| 6 | $4.3 \times 10^{-9}$ | 3.64 | $2.0 \times 10^{-9}$ | acrylic | 350 | 2.0 |

(Rd) adjusted to a level lower than the dynamic resistivity (Rc) of the carrier alone gives a copied image having a high quality.

We claim:

1. A two-component type developer, which comprises a magnetic carrier and an electroscopic toner, wherein the magnetic carrier is a carrier having a dynamic resistivity (Rc) of $5\times10^{9}$ to $5\times10^{11}$ Ω-cm, and the toner is a toner having a static electroconductivity of $6\times10^{-10}$ to $4\times10^{-9}$ s/cm and a dielectric constant (ε) of 2.7 to 3.9 and the ratio ((Rd/Rc) of the dynamic resistivity (Rd) of the developer to the dynamic resistivity (Rc) of the magnetic carrier is in the range of from 0.20 to 0.99.

2. A two-component type developer as set forth in claim 1, wherein the electroconductivity of a binder resin constituting the toner is $1\times10^{-10}$ to $1\times10^{-8}$ s/cm.

3. A two-component type developer according to claim 1, wherein the surface of the magnetic carrier is coated with a resin.

4. A two-component type developer according to claim 1 wherein the ratio (Rd/Rc) of the dynamic resistivity (Rd) of the developer to the dynamic resistivity (Rc) of the magnetic carrier is in the range of from 0.3 to 0.7.

5. A two-component type developer according to claim 1 wherein the magnetic carrier is a carrier having a dynamic resistivity of $5\times10^{9}$ to $5\times10^{11}$ Ω-cm, and the toner is a toner having a static electroconductivity of $9\times10^{-10}$ to $4\times10^{-9}$ s/cm and a dielectric constant (ε) of 2.7 to 3.9.

6. A two-component type developer as set forth in claim 5, wherein the electroconductivity of a binder resin constituting the toner is $6\times10^{-10}$ to $4\times10^{-9}$ s/cm.

7. A two-component type developer according to claim 5 wherein the ratio (Rd/Rc) of the dynamic resistivity (Rd) of the developer to the dynamic resistivity (Rc) of the magnetic carrier is in the range of from 0.3 to 0.7.

8. A two component developer according to claim 1 wherein the developer is a developer having a dynamic resistivity (Rd) of $3.0\times10^{10}$ to $2.5\times10^{11}$.

9. A two-component type developer, which comprises a magnetic carrier and an electroscopic toner, wherein the magnetic carrier is a carrier having a dynamic resistivity (Rc) of $5\times10^{9}$ to $5\times10^{11}$ Ω-cm, and the toner is a toner having a static electroconductivity of $6\times10^{-10}$ to $4\times10^{-9}$ s/cm and a dielectric constant (ε) of 2.7 to 3.9, the developer is a developer having a dynamic resistivity (Rd) of $3.0\times10^{10}$ to $2.5\times10^{11}$, and the ratio (Rd/Rc) of the dynamic resistivity (Rd) of the developer to the dynamic resistivity (Rc) of the magnetic carrier is in the range of 0.30 to 0.70.

10. A two-component type developer according to claim 9 wherein the magnetic carrier is a carrier having a dynamic resistivity (Rc) of $7.7\times10^{10}$ to $4\times10^{11}$, and the ratio (Rd/Rc) of the dynamic resistivity (Rd) of the developer to the dynamic resistivity (Rc) of the magnetic carrier is in the range of 0.36 to 0.71.

* * * * *